US006004157A

United States Patent [19]

Glass

[11] Patent Number: 6,004,157

[45] Date of Patent: Dec. 21, 1999

[54] CONNECTOR MODULE

[75] Inventor: Peter Glass, Napa, Calif.

[73] Assignee: Virco Mfg. Corporation, Torrance, Calif.

[21] Appl. No.: 08/970,186

[22] Filed: Nov. 14, 1997

[51] Int. Cl.[6] ..... H01R 13/73

[52] U.S. Cl. ..... 439/574; 439/535

[58] Field of Search ..... 439/574, 575, 439/535, 540.1

[56] References Cited

U.S. PATENT DOCUMENTS 5,057,039 10/1991 Persing et al. ..... 439/574

*Primary Examiner*—Gary F. Paumen

*Attorney, Agent, or Firm*—James E. Brunton

[57] ABSTRACT

A compact, simple-to-use and readily adjustable connector module which can be easily affixed to a work platform such as a desk or worktable for use in interconnecting various types of electrically operated machines and communication devices, which are positioned on the work platform, with power and communication lines. The connector module includes a housing having a work platform receiving channel which closely receives a portion of the edge of the work platform so that the module can be conveniently interconnected with the work platform by means of a simple, easy-to-use clamping mechanism.

15 Claims, 5 Drawing Sheets

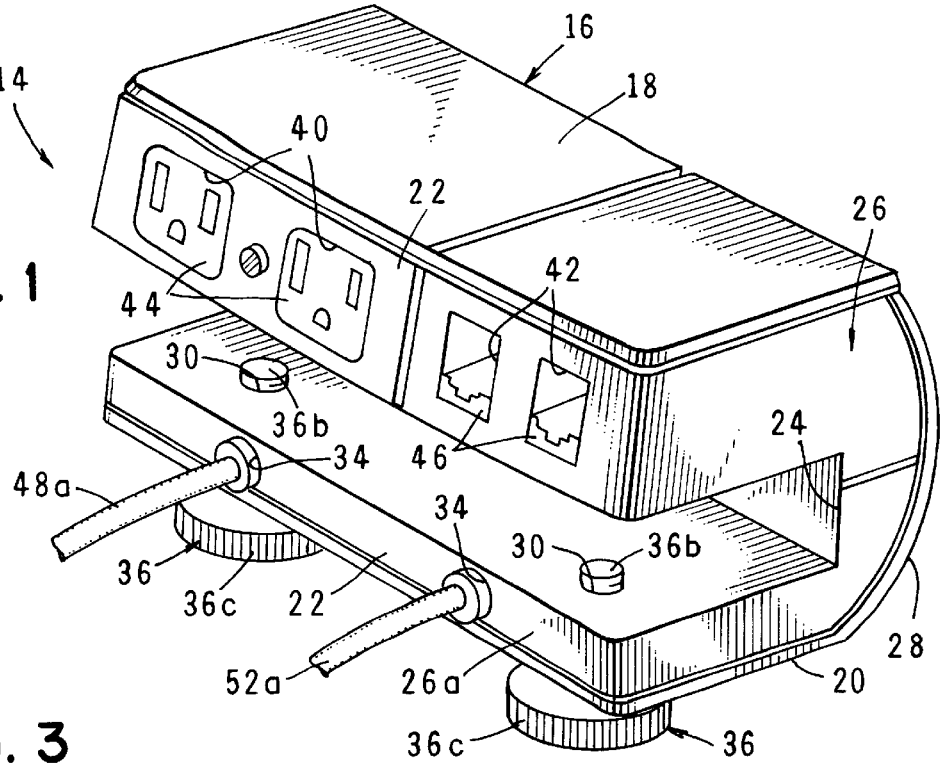
FIG. 1
FIG. 3
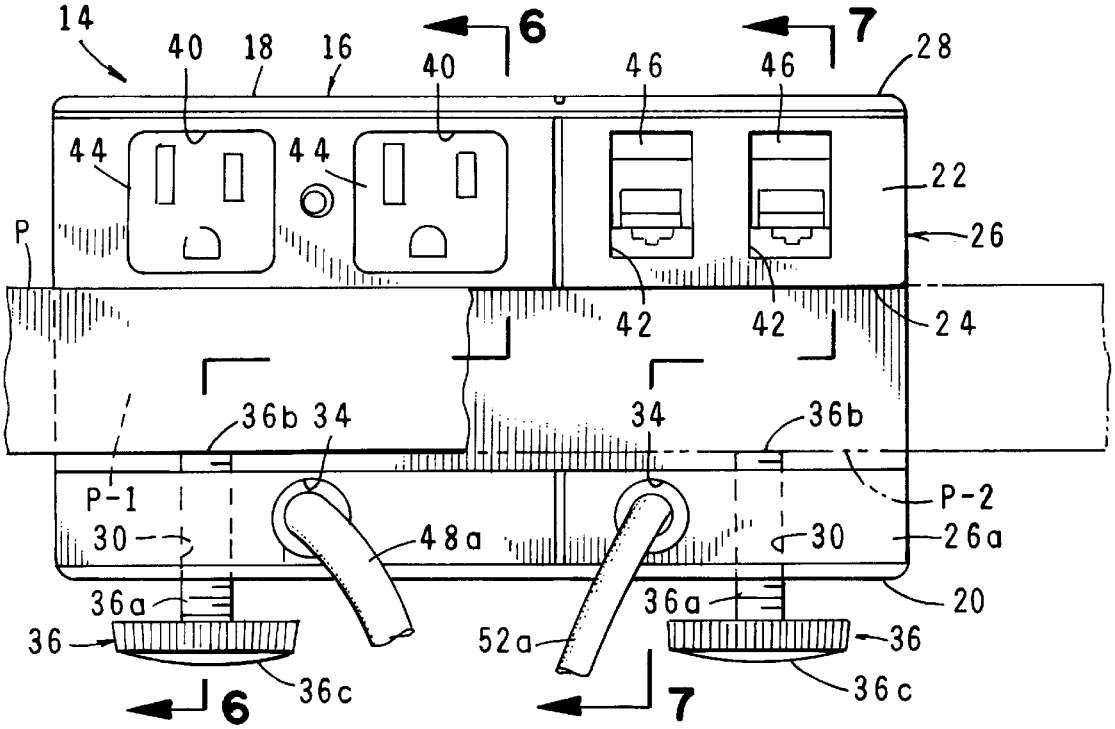

CONNECTOR MODULE

BACKGROUND OF THE INVENTION

1. Field of the Invention

The present invention relates generally to apparatus for interconnecting communication devices with power and communication lines. More particularly, the invention concerns a connector module which can be adjustably connected to a work surface for use in connecting telephone and electronically powered devices positioned on the work surface with remotely located power and communication sources.

2. Discussion of the Prior Art

The interconnection of devices such as lamps, typewriters, adding machines, computers, telephone modems and the like, which are typically used on elevated work surfaces such as found on desks and work tables with remotely located electrical outlets and telephone terminals has traditionally presented substantial safety and wire organization problems. Because electrical power receptacles and telephone jacks are generally wall mounted proximate the floor, the power and communication cables of the electrically powered devices and the telephone randomly extend across the work surface and are then draped downwardly over the edges of the work surfaces. The communication, cables then extend along the floor to one or more of the wall mounted power receptacles and telephone outlets. This arrangement can result in the creation of substantial tripping hazards which can cause both personal injury and equipment damage.

Wire management problems have been exacerbated by the increased use in homes and offices of improved communication systems such as computers, video monitors, modems and complex telephone stations. Accordingly, in recent years work, platforms, such as desks and work tables have been specially designed so as to provide work surface mounted electrical receptacles and telephone jacks. Similarly, recently developed work platforms such as work tables have, on occasion, provided wire management aprons and cable receiving raceways for use in interconnecting electrically powered devices located on the work surface with remotely located communication and power lines.

Additionally, several prior art patents disclose systems for retractably mounting electrical receptacles in work surfaces and the like. Exemplary of such patents is U.S. Pat. No. 4,747,788 issued to Byrne. This patent describes a retractable power center having a rectangular housing which is formed in the work surface. A lower extension is connected to the lower portion of the housing and electrical receptacles are mounted within a manually movable power carriage. A manual application of upward forces on the carriage will cause it to be raised upwardly into an extended operating position which enables the user to energize electrical devices from the receptacles.

A somewhat similar energy center construction is described in U.S. Pat. No. 5,351,173 also issued to Byrne. This improved system is adapted to be mounted within a furniture component and also comprises a manually operable, extendible and retractable communication terminal center which can accept data lines from devices such as computers and telephones. After proper interconnection of the date lines with the communications center, the terminal center can, if desired, be retracted into a lowered, retracted position.

A common drawback of most of the prior art devices which seek to provide improved cable management resides in the undue complexity of the devices. For example, many of the devices include relatively elaborate means for interconnecting the devices with the furniture component which typically requires substantial modification of the furniture component. Further, once installed, most of the prior art devices cannot be moved relative to the work platform thereby limiting their adaptability to respond to repositioning of the communication devices on the work platform. The thrust of the present invention is to overcome these and other drawbacks of the prior art wire management devices by providing an elegantly simple, easy-to-use, and highly versatile connector module for use in connecting communication devices with power and communication lines.

SUMMARY OF THE INVENTION

It is an object of the present invention to provide a compact, simple-to-use and readily adjustable connector module which can be easily affixed to a work platform for use in interconnecting various types of electrically operated machines and communication devices, which are positioned on the work platform, with power and communication lines.

Another object of the invention is to provide a connector module of the aforementioned character which includes a work platform receiving channel which closely receives a portion of the edge of the work platform so that the module can be conveniently interconnected with the work platform by means of a clamping means of simple, easy-to-use construction releasably clamping the connector module to the work platform.

Another object of the invention is to provide a connector module as described in the preceding paragraph which can be easily adjusted relative to the work platform to enable it to be optionally located relative to the communication devices which are to be connected thereto.

Another object of the invention is to provide a connector module of the class described which is of simple construction, comprises a minimum number of moving parts and one which can be inexpensively manufactured.

Another object of the invention is to provide a connector module which is rugged and reliable but yet is extremely attractive in design.

BRIEF DESCRIPTION OF THE DRAWINGS

FIG. 1 is a generally perspective view of one form of the apparatus of the invention.

FIG. 3 is a front elevational view of the apparatus shown in FIG. 1.

DESCRIPTION OF THE INVENTION

Figure 2:
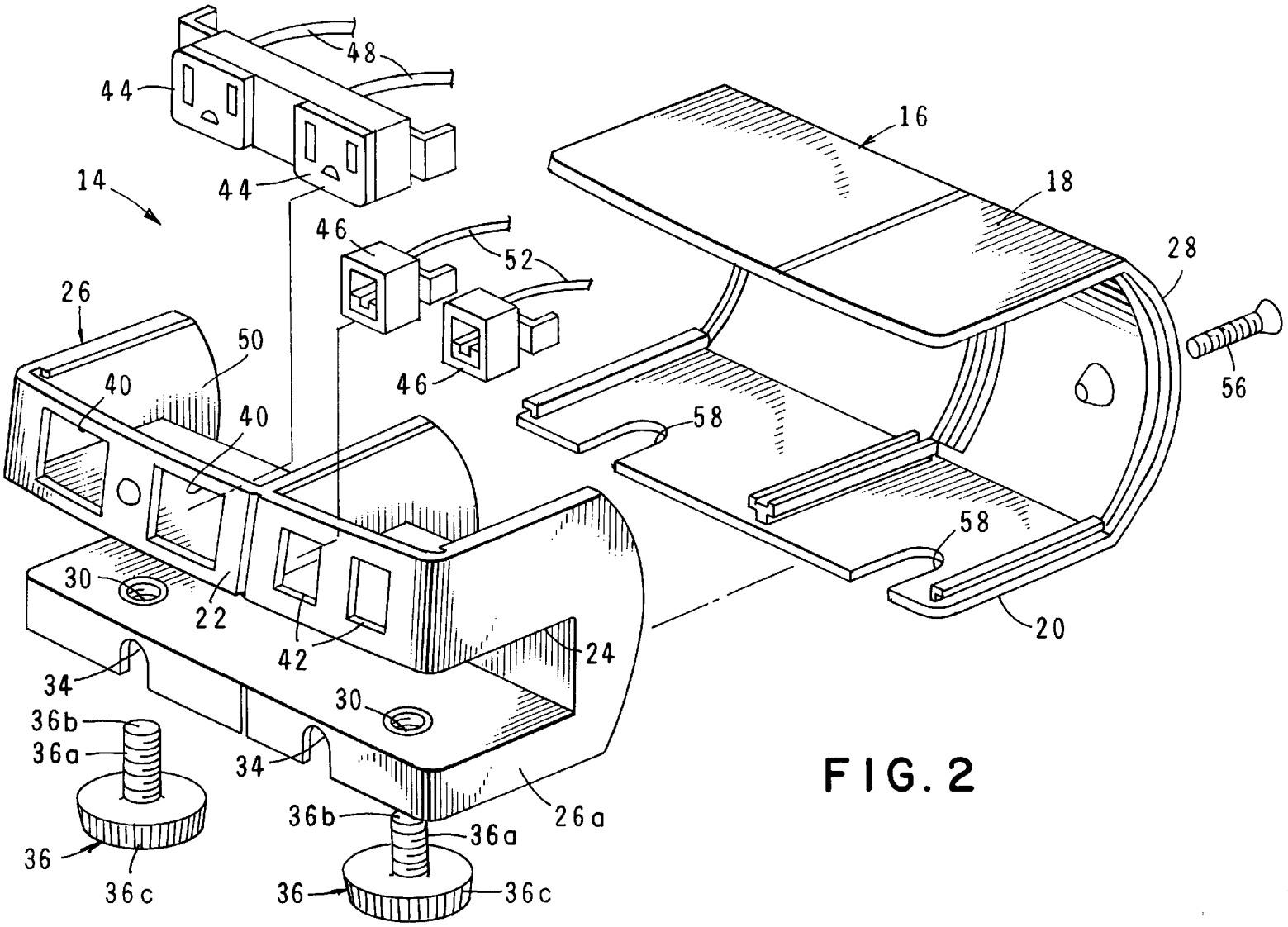
FIG. 2 is a generally perspective, exploded view of the apparatus shown in FIG. 1.

Referring to the drawings, and particularly FIGS. 1, 2 and 3, one form of the connector module of the present invention is there illustrated and generally designated by the numeral 14. Connector module 14 functions to interconnect electrically operated devices and various types of communication devices with remotely located power and communication lines. More particularly, the connector module is ideally suited for interconnecting with power and communication lines devices such as computers, typewriters, adding machines, modems and telephones which are positioned on the upper surface of a work platform such as a desk or worktable.

Figure 4:
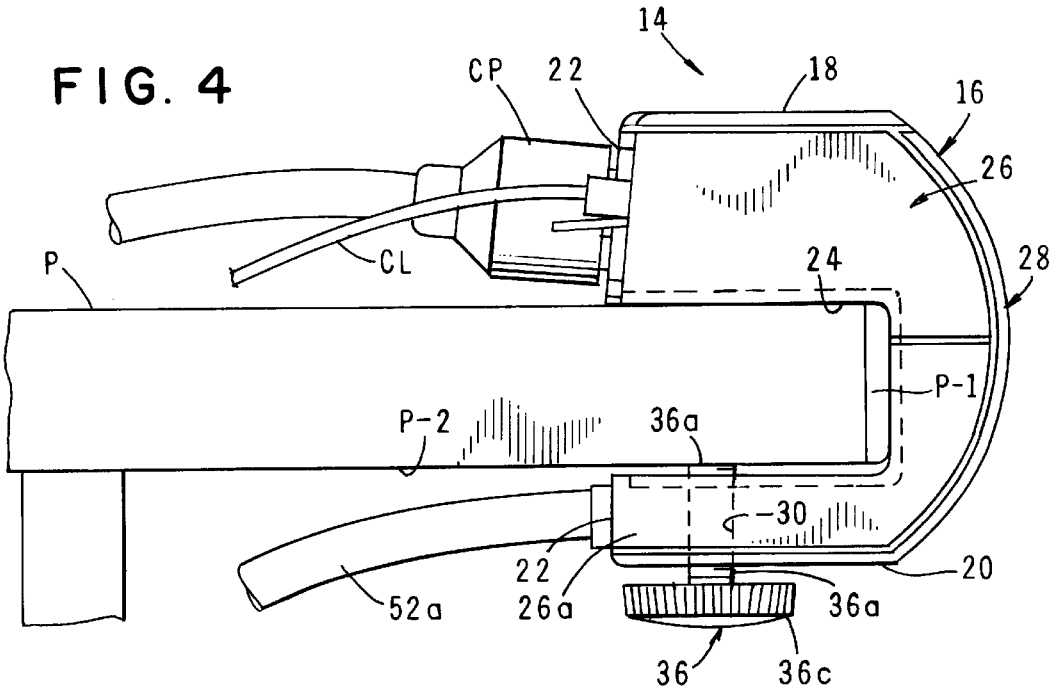
FIG. 4 is a right-side view of the apparatus of the invention shown interconnected with the edge of a work platform.

In the form invention shown in FIGS. 1 though 3, the connector module comprises a housing 16 having top, bottom and front surfaces 18, 20 and 22 respectively. These surfaces cooperate to define a transversely extending channel 24 which is sized so as to closely receive the edge or marginal portion "P-1" of a work platform "P" in the manner best seen in FIG. 4.

As best seen by referring to FIG. 2, the housing 16 of the present form of the invention comprises a frame portion 26 within which channel 24 is formed and a cover portion 28 which is re- movably connected to frame 26 in the manner shown in FIG. 1. For reasons presently to be described the lower portion 26*a* of frame 26 is provided with a pair of transversely spaced apart threaded bores 30. Lower portion 26*a* of the frame is also provided with a pair of transversely, spaced apart cable receiving apertures 34.

Figure 5:
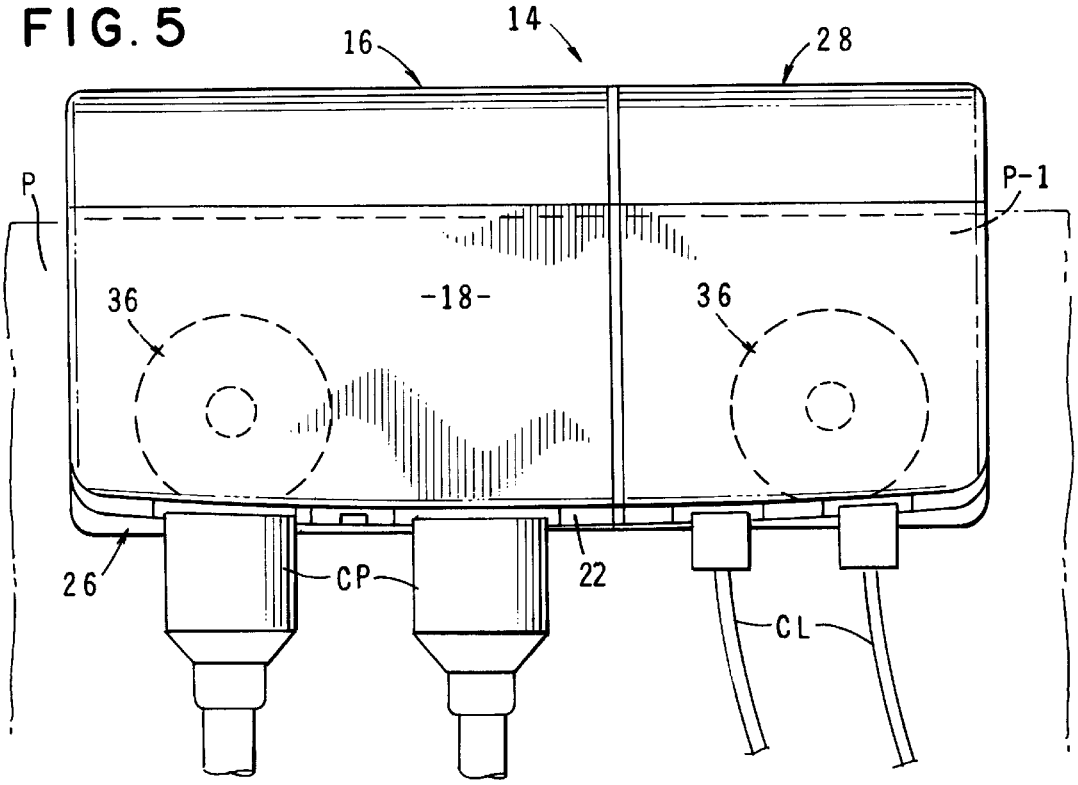
FIG. 5 is a top view of the apparatus shown in FIG. 4.

Receivable within threaded bores 30 are connector means for connecting housing 16 with the work platform. While the connector means can be of on various mechanical forms well known to those skilled in the art, the means are here shown comprising a pair of spaced apart connector members 36 (FIG. 2), which are adjustably connected to the housing for moving into and out of clamping engagement with the work platform "P". As best seen in FIG. 2, connector members 36 here comprise a pair of threaded connector members or screws each having a threaded shank 36*a* which is threadably received within threaded bores 30 of frame portion 26*a*. Each of the threaded shank portions 36*a* of the connectors 36 terminate in a work platform engaging end portion 36*b*. Provided on each of the connector screws 36 at the opposite end of threaded shank portion 36*a* is a generally circular shaped finger engaging head 36*c* for gripping by the user to rotate the shank portions 36*a* relative to the housing so as to move end portions 36*b* thereof into and out of clamping engagement with the lower surface "P-2" of the work platform margin. (See, for example, FIGS. 3 and 5)

As best seen in FIGS. 1 and 3, the front surface of the housing is provided with a plurality of strategically shaped apertures. More particularly, in the form of the invention shown in the drawings, the front surface 22 is provided with a pair of transversely spaced apart electrical receptacle receiving apertures 40 and with a pair of transversely spaced apart telephone jack receiving apertures 42. Received within apertures 40 is a pair of electrical power receptacles 44 which are suitably interconnected with front surface 22 of the housing. As indicated in FIG. 1, receptacles 44 are readily accessible through apertures 40 formed in the front face 22 of the housing. Similarly, a pair of conventional telephone jacks 46 are receivable through apertures 42 and are appropriately connected to front surface 22 of the housing.

Figure 6:
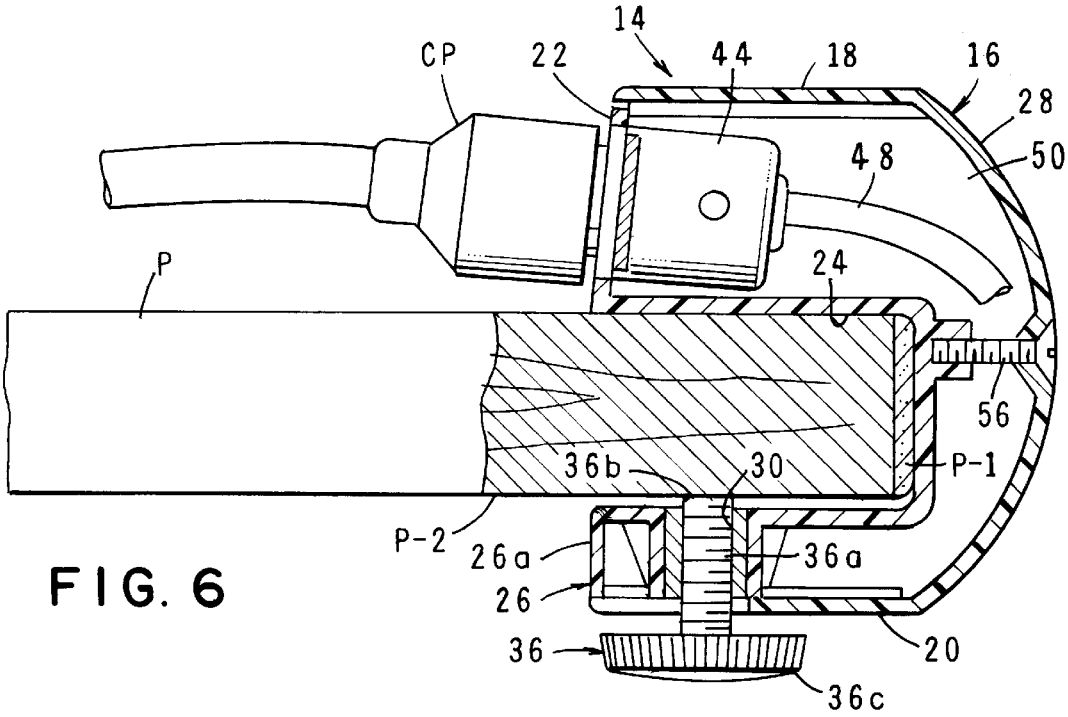
FIG. 6 is a cross-sectional view taken along lines 6—6 of FIG. 3.
Figure 7:
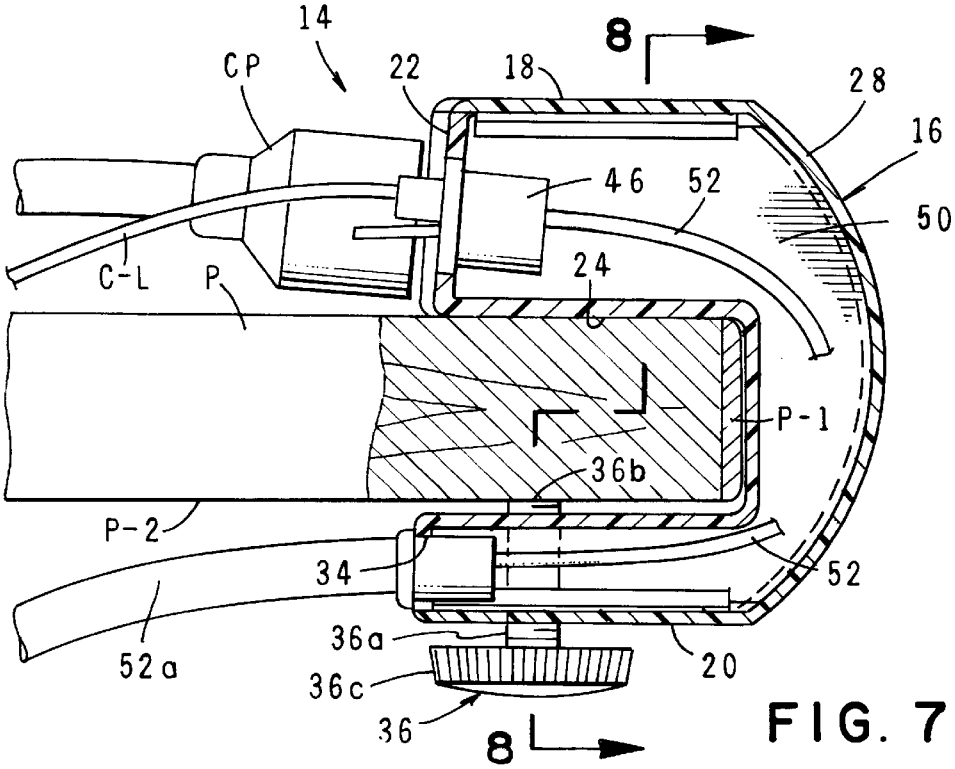
FIG. 7 is a cross-sectional view taken along lines 7—7 of FIG. 3.
Figure 8:
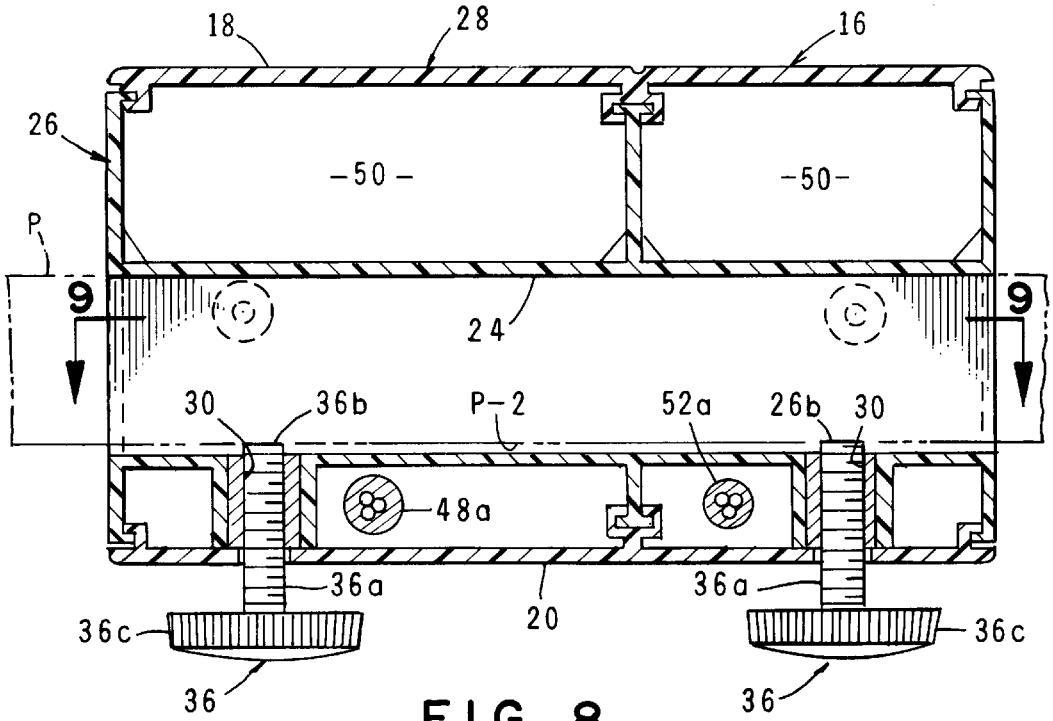
FIG. 8 is a cross-sectional view taken along lines 8—8 of FIG. 7.

A pair of power cords 48 are connected to electrical receptacles 44 (FIG. 2), and extend through an internal chamber 50 (FIG. 6) which is formed within housing 16 through the cooperation of cover 28 and frame portion 26. Power cords 48 are encased within a sheath 48*a* (FIG. 8) so that they can be conveniently passed through a selected one of the openings 34 provided in the lower front face portion of frame portion 26. (FIG. 3) In a similar fashion, communication cords 52 (FIG. 2) are interconnected with phone jacks 40. Cords 52 are encased within a sheath 52*a* (FIG. 8) so that they can be passed through internal chamber 50 and then outwardly through the other of the apertures 34 formed in the front face of the housing. (FIG. 3)

Figure 9:
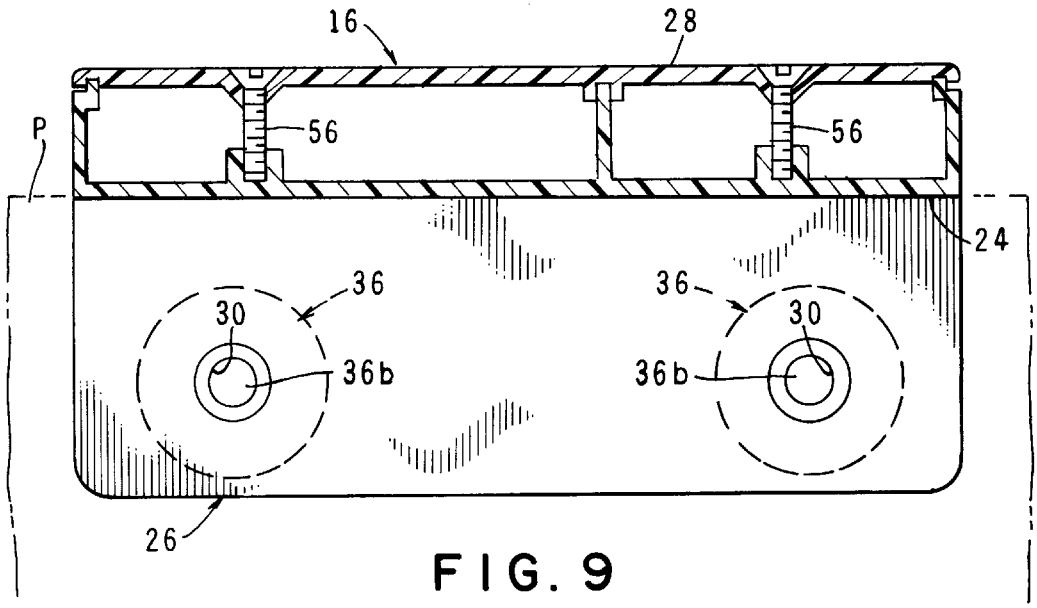
FIG. 9 is a cross-sectional view taken along lines 9—9 of FIG. 8.

In using the connector module of the present invention, cover 26 is appropriately connected to frame 26 by means of threaded connectors 56 (FIGS. 2 and 9). During the connection of cover 28 with frame portion 26, spaced-apart slots 58 which are formed in the lower surface of cover 26 will closely receive shank portions 36*a* of the connector screws 36 (see FIG. 2). With cover 28 appropriately interconnected with frame portion 26, and with the electrical receptacles 44 and the telephone jacks 46 correctly positioned within apertures 40 and 42 respectively, connector module can be interconnected with the circumscribing edge or marginal portion "P-1" of the work platform in the manner shown in FIGS. 3, 4, 6, and 7. This interconnection step is performed by first loosening the connector screws 38 so that the connector module can be easily slipped over the edge of the work platform "P" and then positioning the connector module at an optimum location with respect to the devices which are to be interconnected to the module. When the connector module is in the correct position, screws 36 can be tightened by gripping head portions 36*a* so as to bring terminal end portions 36*b* of the connector screws into secure pressural engagement with the lower surface "P-2" of the edge of the work platform.

With the connector module appropriately affixed to the work platform, power cords 48 can be interconnected with the closest wall mounted electrical power outlet and communication lines 52 can be interconnected with the closest communications outlet such as an appropriately located telephone jack or like communications outlet. With the connector module thusly interconnected with power and with communication lines the connector plugs "CP" of the electrical apparatus to be connected can be interconnected with electrical receptacles 40 in the manner illustrated in FIGS. 6 and 7. Similarly, the communication lines "CL" of the telephones, modems and the like to be connected can be suitably interconnected with phone jacks 42 in the manner shown in FIGS. 4 an 7. (See also FIG. 5)

As previously mentioned, one of the advantages of the connector module of the present invention is its ability to be quickly and easily disconnected from the work platform so that it's location along the marginal edge portion of the work platform can readily be changed to accommodate different surface positioning of electrically operated devices and communication devices such as telephones and modems.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A connector module for interconnecting electrically operated devices and communication devices, which are positioned on a work platform having a top surface, a bottom surface, and a circumscribing margin with power and communication lines comprising:

(a) a housing having top, bottom and front surfaces defining an internal chamber and including a work platform margin receiving channel, said front surface of said housing having a plurality of apertures formed therein;

(b) at least one electrical power receptacle connected to said front surface of said housing, said power receptacle being accessible through one of said apertures formed in said front surface;

(c) a power cord connected to said power receptacle and extending through said internal chamber;

(d) at least one telephone jack connected to said front surface of said housing, said telephone jack being accessible through one of said apertures formed in said front surface;

(e) A communication line connected to said telephone jack and extending through said internal chamber; and (f) connector means connected to said housing for removably connecting said housing to said work platform, said connector means comprising at least one connector member adjustably connected to said bottom surface of said housing for movement into and out of clamping engagement with the work platform.

2. A connector module as defined in claim 1 in which said connector member comprises a connector screw threadably connected to said housing, said connector screw having a threaded shank terminating in a work platform engaging end portion and a finger-engaging head for rotating said shank relative to said housing.

3. A connector module as defined in claim 1 in which said housing comprises a frame portion and a cover portion connected to said frame portion.

4. A connector module as defined in claim 3 in which said cover portion is generally U-shaped in cross section.

5. A connector module as defined in claim 3 in which said connector means comprises a pair of spaced-apart connector members each of which is threadably connected to said frame portion of said housing.

6. A connector module as defined in claim 5 in which said cover portion includes a pair of spaced-apart openings for closely receiving portions of said connector members.

7. A connector module as defined in claim 5 in which said front face of said housing is provided with a pair of spaced-apart cable receiving apertures.

8. A connector module for interconnecting electrically operated devices and communication devices, which are positioned on a work platform having a top surface, a bottom surface, and a circumscribing margin with power and communication lines comprising:

(a) a housing having top, bottom and front surfaces defining an internal chamber and including a work platform margin receiving channel, said front surface of said housing having a plurality of apertures formed therein and including a frame portion and a cover portion removably connected to said frame portion;

(b) at least one electrical power receptacle connected to said front surface of said housing, said power receptacle being accessible through one of said apertures formed in said front surface;

(c) a power cord connected to said power receptacle and extending through said internal chamber;

(d) at least one telephone jack connected to said front surface of said housing, said telephone jack being accessible through one of said apertures formed in said front surface;

(e) a communication line connected to said telephone jack and extending through said internal chamber; and (f) connector means connected to said housing for removably connecting said housing to said work platform, said connector means comprising at least one connector member adjustably connected to said bottom surface of said housing for movement into and out of clamping engagement with the work platform, said connector member comprising at least one connector screw threadably connected to said frame portion of said housing, said connector screw having a threaded shank terminating in a work platform engaging end portion and a finger-engaging head for rotating said shank relative to said housing.

9. A connector module as defined in claim 8 in which said cover portion is generally U-shaped in cross section.

10. A connector module as defined in claim 9 in which said connector means comprises a pair of space-apart connector members each of which is threadably connected to said frame portion of said housing.

11. A connector module as defined in claim 10 in which said front face of said housing is provided with a pair of spaced apart cable receiving apertures.

12. A connector module for interconnecting electrically operated devices and communication devices, which are positioned on a work platform having a top surface, a bottom surface, and a circumscribing margin with power and communication lines comprising:

(a) A housing having top, bottom and front surfaces defining an internal chamber, said front surface having a plurality of spaced apart apertures formed therein, said housing comprising:

(i) a frame portion having a channel formed therein for closely receiving a portion of the circumscribing margin of the work platform and a pair of internally threaded bores disposed proximate said channel;

(ii) a cover portion removably connected to said frame portion;

(b) connector means connected to said frame portion of said housing for removably connecting said frame portion to said work platform, said connector means comprising a pair of threaded connector members threadably received within said internally threaded bores of said frame portion for movement into and out of clamping engagement with the work platform, each said connector member comprising a connector screw having an externally threaded shank terminating in a work platform engaging end portion and a finger-engaging head for rotating said shank relative to said housing;

(c) a pair of electrical power receptacles connected to said front surface of said housing, said power receptacles being accessible through a selected two of said apertures formed in said front surface;

(d) a power cord connected to each of said power receptacles and extending through said internal chamber; and (e) a pair of telephone jacks connected to said front surface of said housing, said telephone jacks being accessible through a selected two of said apertures formed in said front surface; and (f) a communication line connected to each of said telephone jacks and extending through said internal chamber.

13. A connector module as defined in claim 12 in which said frame portion is provided with cable receiving apertures for receiving said power cords.

14. A connector module as defined in claim 12 in which said frame portion is provided with a communication line receiving aperture for receiving said communication lines.

15. A connector module as defined in claim 12 in which said cover portion is generally U-shaped in cross section and includes a pair of spaced-apart slots for receiving said threaded shanks of said connector screws.

* * * * *